US010794116B2

(12) United States Patent
Kanuri

(10) Patent No.: US 10,794,116 B2
(45) Date of Patent: Oct. 6, 2020

(54) DOOR BREAKOUT DETECTION SYSTEM AND METHOD

(71) Applicant: Overhead Door Corporation, Lewisville, TX (US)

(72) Inventor: Sree Lakshmi Kanuri, Lewisville, TX (US)

(73) Assignee: Overhead Door Corporation, Lewisville, TX (US)

( * ) Notice: Subject to any disclaimer, the term of this patent is extended or adjusted under 35 U.S.C. 154(b) by 338 days.

(21) Appl. No.: 15/877,518

(22) Filed: Jan. 23, 2018

(65) Prior Publication Data

US 2019/0226276 A1 Jul. 25, 2019

(51) Int. Cl.

| | |
|---|---|
| ***E06B 9/68*** | (2006.01) |
| ***E06B 9/82*** | (2006.01) |
| ***E06B 9/40*** | (2006.01) |

(52) U.S. Cl.

CPC ..... *E06B 9/82* (2013.01); *E06B 9/40* (2013.01); *E06B 9/68* (2013.01); *E06B 2009/6818* (2013.01)

(58) Field of Classification Search

CPC ..... E06B 9/40; E06B 9/13; E06B 9/68; E06B 2009/6818; E06B 9/82; E06B 9/88; E06B 2009/885; E06B 9/58; E06B 9/581; E06B 2009/585

See application file for complete search history.

(56) References Cited

U.S. PATENT DOCUMENTS

| | | | | |
|---|---|---|---|---|
| 5,141,044 | A * | 8/1992 | Hying | E06B 9/40 160/265 |
| 5,601,133 | A * | 2/1997 | Krupke | E06B 9/13 160/265 |
| 5,638,883 | A * | 6/1997 | Schulte | E06B 9/17046 160/265 |
| 6,598,648 | B1 | 7/2003 | Schulte | |
| 6,612,357 | B1 * | 9/2003 | Beringer | E06B 9/88 160/10 |
| 6,964,289 | B2 | 11/2005 | Schulte | |
| 7,138,589 | B2 * | 11/2006 | Tanaka | H01H 15/102 200/43.04 |
| 7,151,450 | B2 * | 12/2006 | Beggs | E06B 9/581 340/545.1 |
| 8,069,897 | B2 | 12/2011 | Kraeutler | |
| 8,237,383 | B2 * | 8/2012 | Shier | E06B 9/68 318/16 |
| 9,187,953 | B2 * | 11/2015 | Drifka | E06B 9/58 |
| 9,493,984 | B2 * | 11/2016 | Casey | E06B 9/581 |

* cited by examiner

*Primary Examiner* — Katherine W Mitchell
*Assistant Examiner* — Abe Massad
(74) *Attorney, Agent, or Firm* — Haynes and Boone, LLP

(57) ABSTRACT

A break-out door sensor system is provided. In one aspect, the system includes: a door; a sensor located on the door; a trigger connected to the door and located proximate to the sensor and configured to move to an actuating position, and when in the actuating position, the trigger contacts the sensor causing the sensor to emit a signal, the trigger being biased away from the actuating position; and a camming surface on the trigger, wherein dimensions of the trigger and the trigger's location on the door with respect to the sensor including the location and dimensions of the camming surface are selected to cause the trigger to move to the actuating position when the camming surface moves against door guide forming a channel and the trigger moves out of the channel.

20 Claims, 5 Drawing Sheets

DOOR BREAKOUT DETECTION SYSTEM AND METHOD

TECHNICAL FIELD

This disclosure relates generally to a door breakout detection system and, more particularly, to a breakout detection feature for a high speed roll up door.

BACKGROUND

Roll up doors are used for providing and denying access to openings. The doors are made of a flexible material that allows the door to be rolled on a roll tube mounted above the portal. A roll up door is often controlled by a door controller. Typically a door frame is used to contain the side edges of the door. Sometimes forces are exerted on the door to move it out of the door frame. Examples of such forces include wind and collisions involving the door with vehicles or other objects attempting to pass through the portal. If a force on the door is significant enough, the door may break out of the door frame. Having the door broken out of and not contained in the door frame can be undesirable for a variety of reasons. As such, it would be desirable to have a system and method for detecting when the door has broken out of the door frame.

SUMMARY

The foregoing needs are met to a great extent by embodiments in accordance with the present disclosure wherein in some embodiments, a system and method is provided for detecting when the door has broken out of the door frame.

In one aspect, the disclosure describes a door sensor system. The system includes: a door; a sensor located on the door; a trigger connected to the door and located proximate to the sensor and configured to move to an actuating position, and when in the actuating position, the trigger contacts the sensor causing the sensor to emit a signal, the trigger being biased away from the actuating position; and a camming surface on the trigger, wherein dimensions of the trigger and the trigger's location on the door with respect to the sensor including the location and dimensions of the camming surface are selected to cause the trigger to move to the actuating position when the camming surface moves against door guide forming a channel and the trigger moves out of the channel.

In another aspect, the disclosure describes a door sensor system. The door sensing system includes: a door mounted over an opening, the door configured to move between open and closed positions to allow and deny access through the opening; a door guide forming a channel located to the side of the opening; a sensor located on the door; a trigger connected to the door and located proximate to the sensor and configured to move to an actuating position, and when in the actuating position, the trigger contacts the sensor causing the sensor to emit a signal, the trigger being biased away from the actuating position; and a camming surface on the trigger, wherein dimensions of the trigger and the trigger's location on the door with respect to the sensor including the location and dimensions of the camming surface are selected to cause the trigger to move to the actuating position when the camming surface slides against the door guide channel and when the trigger moves out of the channel.

In yet another aspect, the disclosure describes a method for controlling a door. The method includes: locating a trigger movable to an actuating position on a door; locating a sensor proximate to the trigger; providing a door guide; and configuring the location of the trigger and sensor so that when the trigger leaves the door guide, the trigger will contact the door guide and move to the actuating position and contact the sensor causing the sensor to emit a signal.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Additional features, advantages, and aspects of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate aspects of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION

Figure 1:
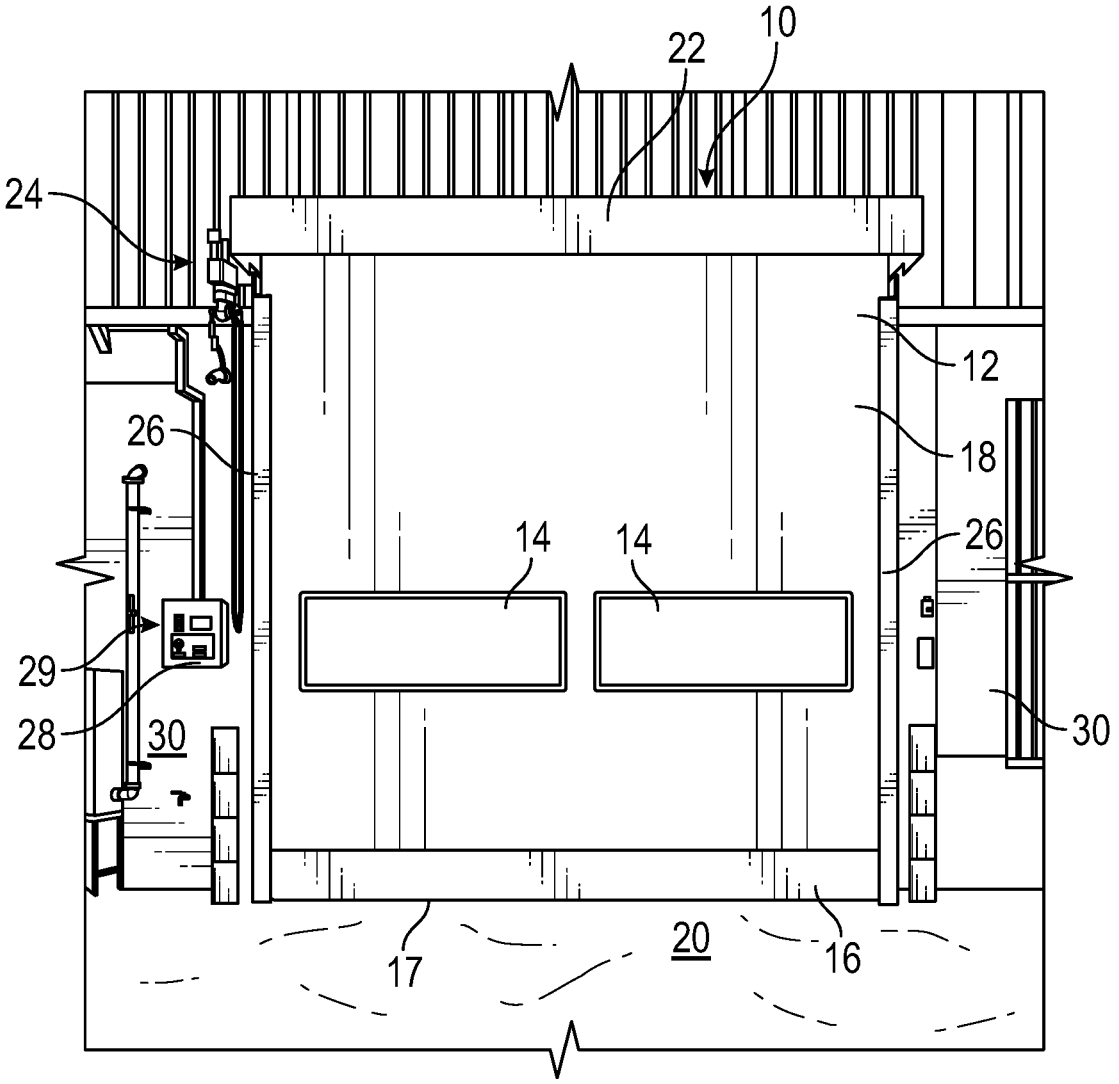
FIG. 1 is a front view of a high speed rolling door having a door controller with a breakout detection system.

The aspects of the disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the disclosure. The examples used herein are intended merely to facilitate an understanding of ways in which the disclosure may be practiced and to further enable those of skill in the art to practice the aspects of the disclosure. Accordingly, the examples and aspects herein should not be construed as limiting the scope of the disclosure, which is defined solely by the appended claims and applicable law. Moreover, it is noted that like reference numerals represent similar parts throughout the several views of the drawings.

FIG. 1 shows a door system 10 in accordance with an embodiment of the disclosure. The door system 10 includes a door 12. Optionally, the door 12 may include windows or vision panels 14. In some embodiments, the door 12 may be made of a fabric material 18 and is a roll-up type door 12. In other embodiments, the door 12 may be a mult-layered insulated door 12. The door 12 extends to the floor 20. The door 12 may include a bottom seal 16 at the bottom end 17 of the door 12 and the bottom seal 16 contacts the floor 20 when the door 12 is in a closed position. A hood 22 is located above the door 12 and may hide the structure that mounts the door 12 and the roller that the door 12 winds around.

A drive mechanism 24 is mounted near the hood 22 and is operatively connected to the door 12 and/or roller to operate the door 12. Vertical columns 26 that act as door 12 guides are located at either side of the door 12. A control panel 28 having a user interface 29 is mounted to the wall 30 adjacent to the vertical columns 26 which are also mounted to the wall 30. The control panel 28 is operatively connected to the drive mechanism 24 and controls the door 12 via controlling the drive mechanism 24. The user interface 29 allows a user to interact with the control panel 28 to operate the door 12.

Figure 2:
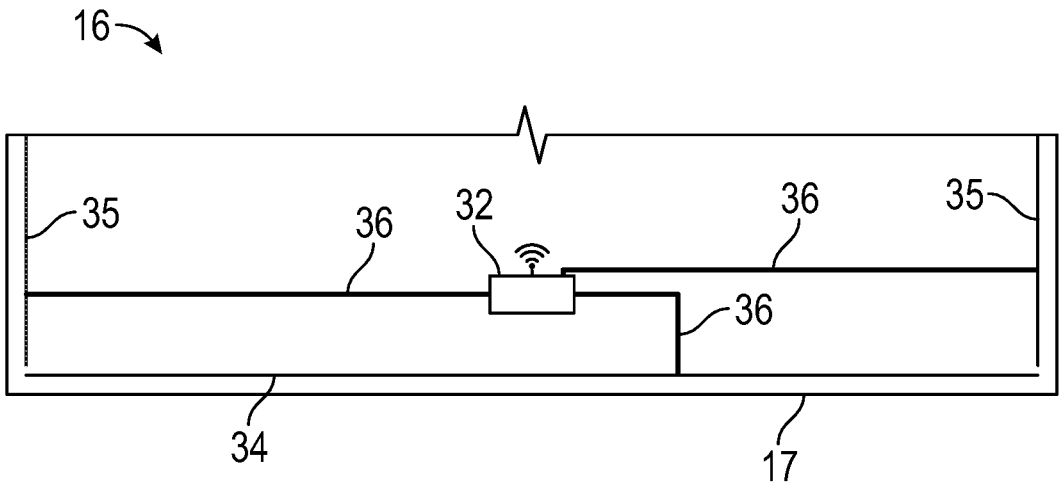
FIG. 2 is a partial exposed view of a bottom portion of a rolling door.
Figure 3:
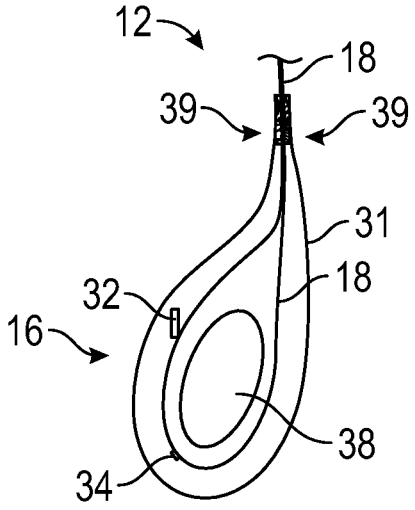
FIG. 3 is a partial cross-sectional side view of a bottom portion of a rolling door.

FIGS. 2 and 3 are front and side views respectively of the bottom seal 16. In FIG. 2, the outer cover 31 (shown in FIG. 3) of the bottom seal 16 is removed to better show components located in the bottom seal 16. FIG. 3 shows the components of the door seal 16 spaced farther apart from each other than would normally occur to better show the seal 16 components (in other words, FIG. 3 is not to scale). In some embodiments, an impact sensor 34 is located near the bottom end 17 of the door 12. The impact sensor 34 is operatively connected to the control panel 28 to send a signal to the control panel 28 when the bottom end 17 of the door 12 has impacted the floor 20 (shown in FIG. 1).

As shown in FIG. 2, side sensors 35 are located on either side of the door 12. In the embodiment shown, the side sensors 35 are in form of a tape switch 35. The side sensors 35 also referred to herein as a break-out sensor or tape switch 35. The break-out sensor 35 will be discussed in further detail below. In the embodiment shown in FIGS. 2 and 3, the impact sensor 34 and break-out sensor 35 are operatively connected to a transceiver 32 located in the bottom seal 16 via conductors 36. When the transceiver 32 receives a signal from the break-out sensors or bottom sensor 34, than the transceiver 32 sends a signal to the control panel 30 via a wireless connection. In other embodiments, the impact sensor 34 and/or break-out sensors 34 may use a wireless connection to send a signal directly to the control panel 30.

The door seal 16 also includes a weight 38. The weight 38 can extend along the width of the door 12 or be located at certain locations along the width of the door 12. The weight 38 may be made of any number of suitable materials. In some embodiments the weight 38 may include lead and/or steel shot. In other embodiments the weight 38 may be sand. Having the weight 38 be made of many different pellets such as shot or grains of sand may help dissipate a shock created by the door 12 hitting the floor 20.

As shown in FIG. 3, the door fabric 18 is looped back on itself and the weight 38 is located in the loop of door fabric 18. The door fabric 18 is welded or otherwise attached back on itself to create a space to hold the weight 38. An outer cover 31 is placed around the bottom end 17 of the door 12, the weight 38, the transceiver 32, impact sensor 34, and conductors 36 to help protect these components. In some embodiments, the outer cover 31 is made of the same material as the door 12 and attaches to the door 12 via a hook and loop connection 39. The outer cover 31 may also be made of other suitable materials and connections between the outer cover 31 and the door 12 may also be used in accordance with this disclosure.

Figure 4:
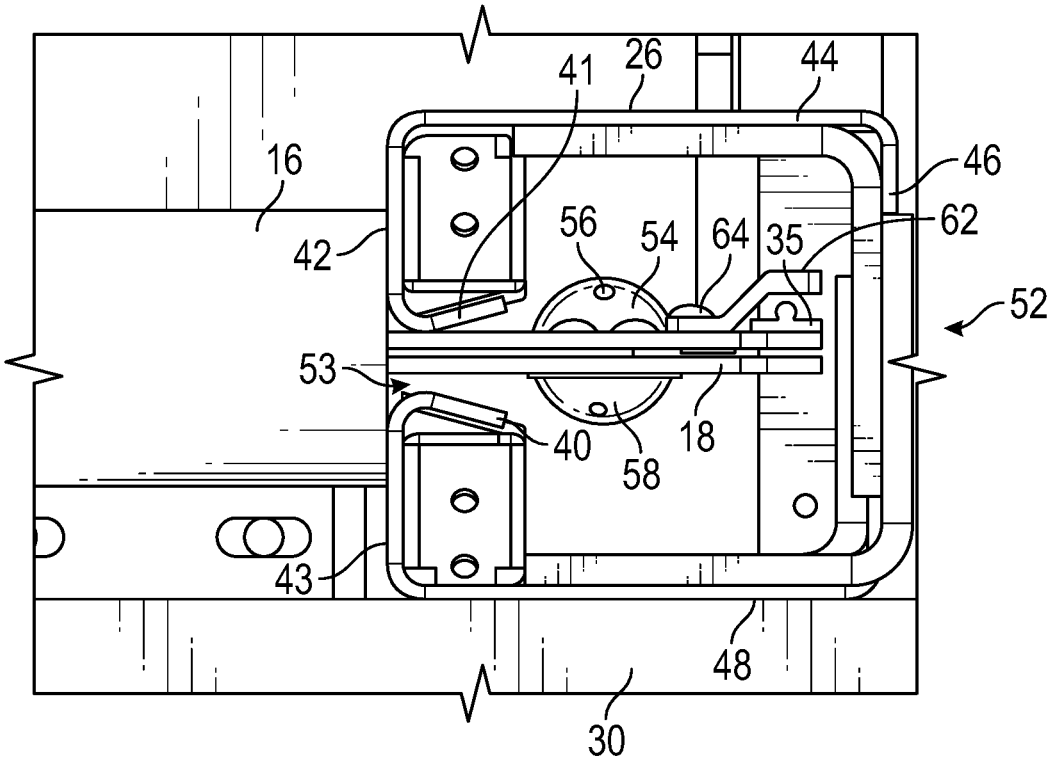
FIG. 4 is partial bottom view of a right side door guide with the door residing in the door guide.
Figure 5:
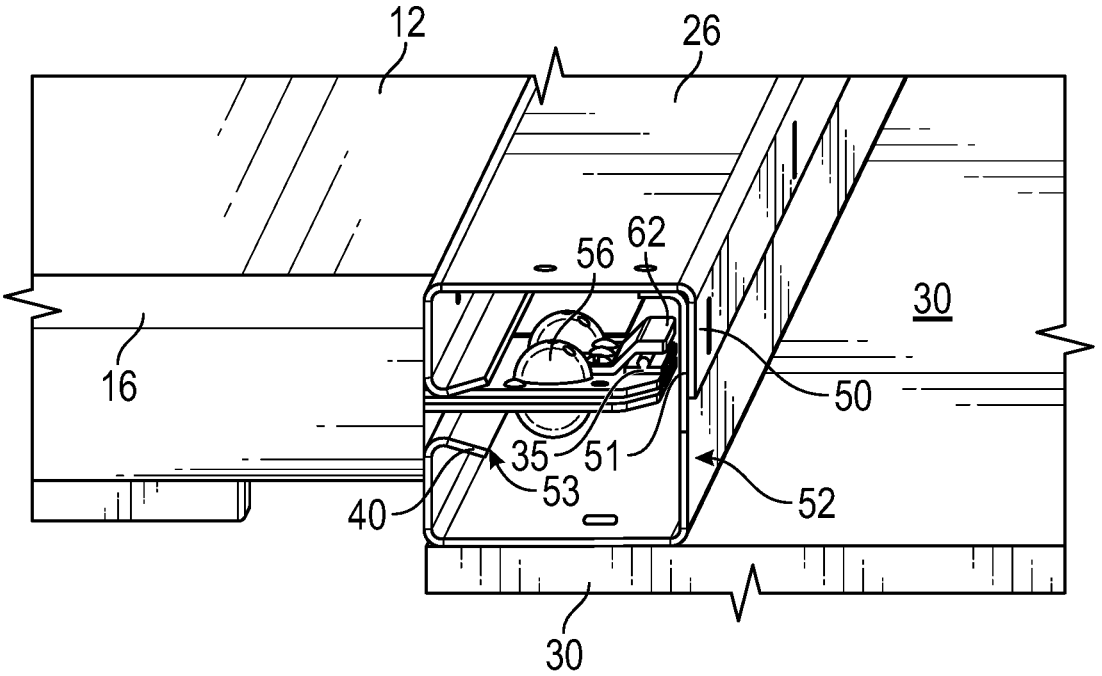
FIG. 5 is partial perspective bottom view of a right side door guide with the door residing in the door guide.
Figure 6:
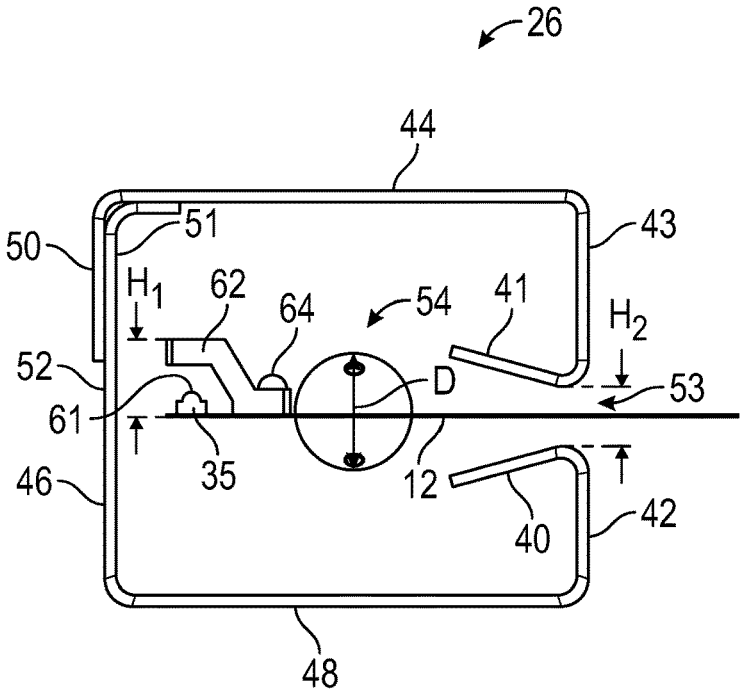
FIG. 6 is an enlarged, partial cross-sectional side view of a left side door guide having the door residing therein.
Figure 7:
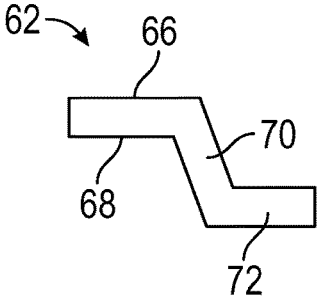
FIGS. 7-11 are side views of triggers having various shapes.
Figure 8:
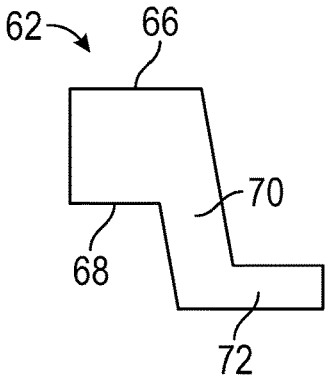
Figure 9:
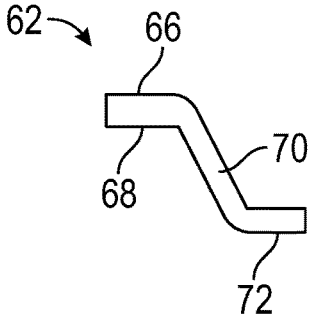
Figure 10:
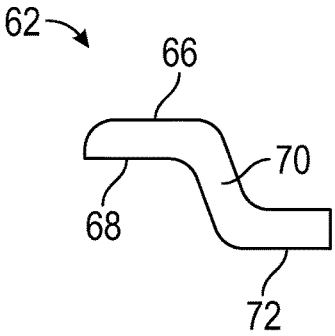
Figure 11:
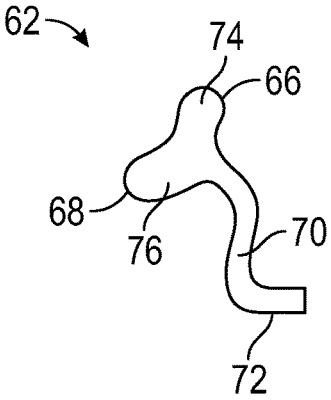
Figure 12:
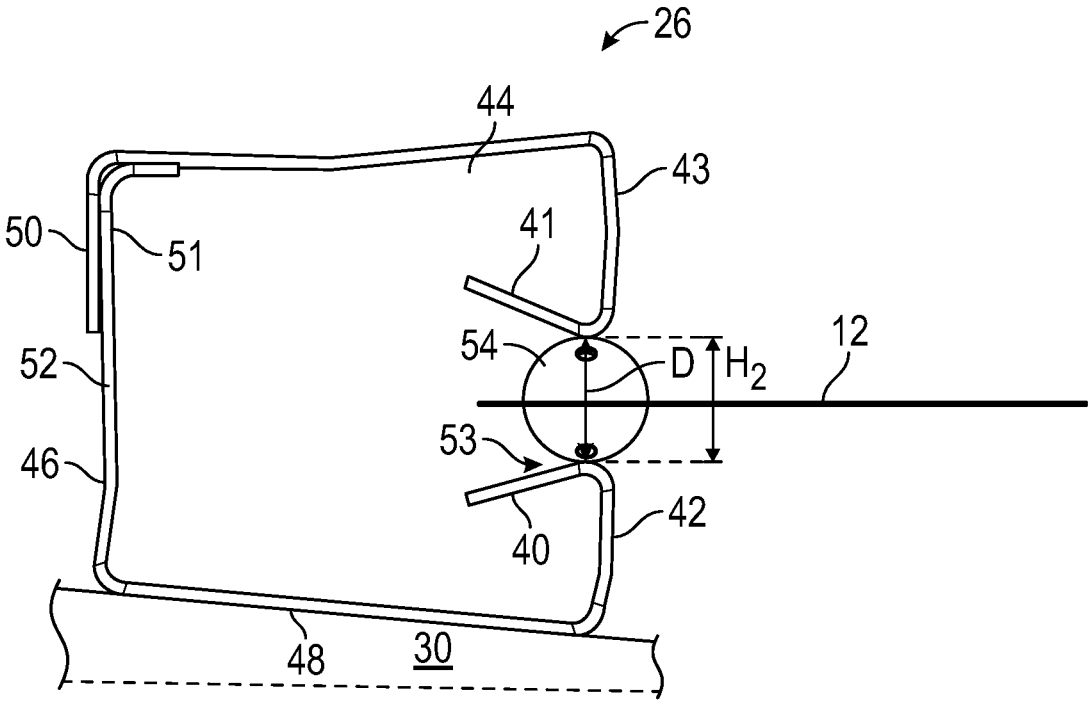
FIG. 12 is an enlarged, partial cross-sectional side view of a left side door guide where the door guide is flexing to allow the retaining structure to exit the door guide.
Figure 13:
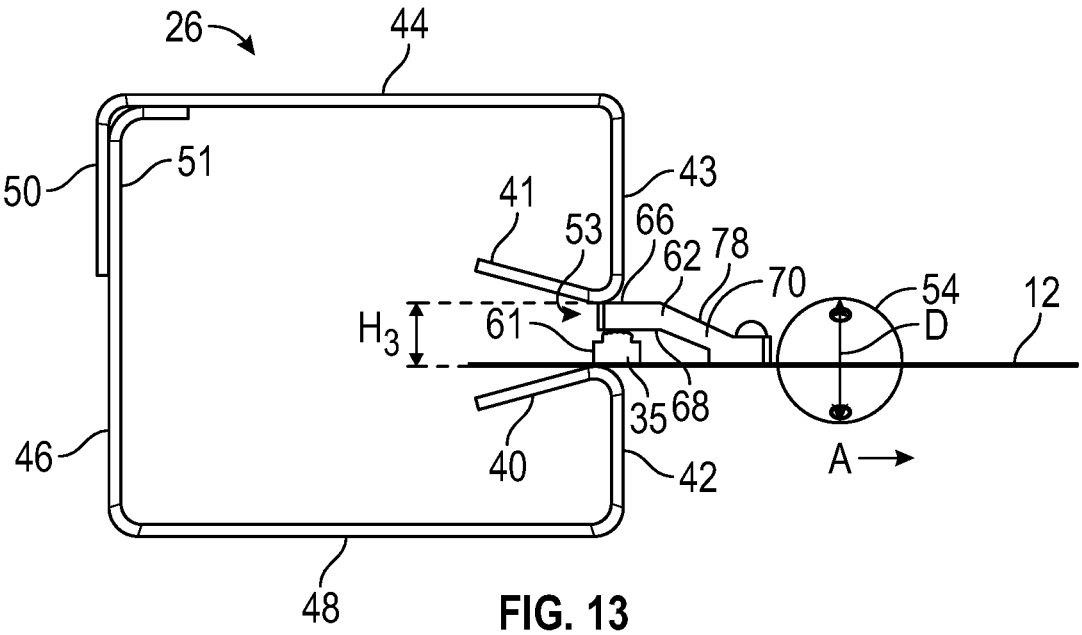
FIG. 13 is an enlarged, partial cross-sectional side view of a left side door guide where the trigger is moving to the actuating position to case the sensor to emit a signal as the trigger moves out of a channel in the door guide.

FIGS. 4-6 show an underside of a door guide 26 (also referred to as the side columns 26 or door frame 26) with the door 12 located in the door guide 26. FIGS. 4-5 show a right side door guide 26 and FIGS. 6 and 12-13 show a left side door guide 26. It should be understood that the left side door guide 26 is substantially a mirror image of the right side door guide 26 and therefore is not shown or described in detail as such an illustration and description is unnecessary. As shown, the bottom seal 16 is not located in the door guide 26. The door guide 26 has two angled sections 40 and 41. The door guide 26 has sides 42, 43, 44, 46, 48, 50, and 51. Sides 50 and 51 overlap each other to form an overlapped portion 52. The sides 42, 43, 44, 46, 48, 50, and 51 are ranged in a generally square or rectangle shape as shown. The sides 42, 43, 44, 46, 48, 50, and 51 as well as the two angled sections 40 and 41 may be made of a resilient metal such as aluminum, spring steel, or any other suitable metal alloy. The angled sections 40 and 41 (also known as angles 40 and 41) are spaced apart from each other and define a channel 53. The channel 53 has an opening dimension as shown by H2 in FIG. 6.

To help retain the door 12 in the door guide 26, the door 12 is equipped with retainers 54. The retainers 54 are shown as round shaped and are also referred to as retaining balls 54. The retaining balls 54 may be made of plastic clamshells that attach to the door 12 by being counter screwed together. The retaining balls 54 have a diameter D as indicated in FIG. 6. To help retain the door 12 in the door guide 26, the diameter D is greater than the channel width H2. In other embodiments, the retainers 54 may not be spherically shaped, and may be made of other materials but will have a thickness that is greater than the channel width H2.

There may be some instances when the door 12 leaves the door guide 26. For example, if the door 12 suffers a collision with a vehicle, the force of the impact may be sufficient to cause the door 12 to leave the door guide 26. It may be desirable to know if the door 12 had left the door guide 26. To this end, the door 12 is equipped with the side sensors 35 described above. The side sensors 35 may be commonly available tape switches that are configured to emit a signal if a resilient portion 61 of the sensor 35 is compressed.

A trigger 62 is attached to the door 12 via fasteners 64 or by some other suitable manner. The trigger 62 is located and configured adjacent to the side sensor 35. The trigger 62 is movable. In some embodiments the trigger 62 may be resilient and flexible, in other embodiments the trigger 62 may pivot or move in some other way. Optionally, the trigger 62 is biased away from a position where the trigger 62 contacts the sensor 35. In embodiments where the trigger 62 is biased away from the sensor 35, the trigger 62 may be made of a resilient material that is biased to be in a position away from the sensor 35. In other embodiments, a biasing element such as a spring may be used. The trigger 62 extends above the door 12 by a dimension indicated by H1 in FIG. 6. The shape and composition of the trigger 62 may vary and be selected for a given installation.

FIGS. 7 through 11 illustrate non-exclusive examples of various trigger 62 shapes that may be used in accordance with the present disclosure. In general, the trigger 62 includes a top surface 66 that acts as a camming surface when the trigger 62 moves through the channel 53 (see FIG. 13). The trigger 62 also has an undersurface 68 that may contact and deform the resilient portion 61 of the tape switch 35 (See FIG. 13). In various embodiments, the trigger 62 may have a flexible neck 70 for facilitating movement and flexure of the trigger 62 and a base 72 that allows the trigger 62 to attach to the door 12. Other trigger 62 designs may have additional or other features such as protrusions 74 (which may have a camming surface) and 76 (which may contact the tape switch 35).

FIG. 12 illustrates a retaining member 54 leaving the door guide 26. Various elements shown in FIGS. 4, 5, and 6 have been removed to avoid overcrowding FIG. 12. The door 12 is exerting a tensile force to pull the retaining member 54 out of the door guide 26. The retaining member 54 has moved along the angles 40 and 41 to the most narrow part of the channel 53. Because D1 is greater than the initial H2 (as shown in FIG. 6), the angles 40, 41 and sides 42, 43, 44, 46, 48, 50, and 51 flex to accommodate the retaining member 54 moving through and out of the channel 53. To allow the retaining member 54 to move out of the channel 53, H2 must be lengthened by flexure of the door frame 26 so that H2 will equal Dl. As shown in FIG. 12, because side 48 is attached to the wall 30, the flexure of side 48 is small to none. The overlapping portion 52 made of sides 50 and 51 may have less flexing due to the fact that they are overlapping. The materials, dimensions and configuration of the angles 40, 41 and sides 42, 43, 44, 46, 48, 50, and 51 may be selected to allow an amount and location of desired flexure for an anticipated amount of tensile force from the door 12 to act on the retaining member 54 to allow the retaining member 54 to move through and out of the channel 53.

While a variety of locations and settings can accommodate embodiments of the present disclosure, it is anticipated that the materials, dimensions and configuration of the angles 40, 41 and sides 42, 43, 44, 46, 48, 50, and 51 may be selected to require a significant and/or localized force such as that associated with a collision with the door 12 to cause the retaining member 54 to be pulled out of the door frame 26. In some embodiments, forces such as those caused by wind (under normal conditions) would be too small to pull the retaining members 54 out of the door frame 26. Further, because the retaining members 54 are located at intervals along the sides of the door 12, and wind is generally not localized but rather acts upon the whole door 12 at once, a wind event (such as during a storm) strong enough to pull out all (or many) of the retaining members 54 would likely be large enough to cause the door 12 to tear, break, or otherwise fail before all (or many) of the retaining members 54 would be pulled out of the door frame 26.

As discussed above, it would be desirable to detect when the door 12 has exited the door frame 26. FIG. 13 shows the trigger 62 contacting the tape switch 35 due to the door 12 exiting the door frame 26. An event such as a vehicle collision with the door 12 has caused the retainer 54 to exit the door frame 26 through the channel 53 as described with respect to FIG. 12. The door frame 26 has rebounded back from the flexed position shown in FIG. 12 after the retainer 54 exited the channel 53. Due to the tensile forces on the door 12 as a result of the event that caused the door 12 and retainer 54 to break out of the door frame 26, the door 12 continues to move out of the door in the direction of arrow A. As the trigger 62 moves through the channel 53 the top surface 66 and, in some embodiments a surface 78, on the flexible neck 70 of the trigger 62, contact and cam against the angle 40. As a result, surface 66 and optionally surface 78 become camming surfaces to move the trigger 62 to an actuating position where the under surface 68 of the trigger 62 contacts and deforms the resilient portion 61 of the sensor 35 to cause the sensor 35 to emit a signal. The door 12 slides against and may cam against angle 41 as the door 12 moves through the channel 53.

It will be appreciated that in some embodiments, the distance H3 which is the height of the door 12, the deformed trigger switch 35, and the trigger 62 in the actuating position is equal or greater than the width to the channel 53 H2 when the door frame 26 is not flexed as shown in FIG. 6. In other embodiments, H3 has shown in FIG. 13 may be greater than the width of the unflexed channel H2 as shown in FIG. 6 particularly in embodiments where it is anticipated that the door frame 26 will not have fully recovered from flexing when the retainer 54 moved out of the channel 53. After reviewing this disclosure, one of ordinary skill in the art will be able to select materials and dimensions for the angles 40, 41 and sides 42, 43, 44, 46, 48, 50, and 51 and the dimensions for D1, H1, H2, and H3 to achieve desired characteristics of the door system 10 to include activating the sensor 35 when the door 12 breaks out of the door frame 26 as shown in FIG. 13.

As discussed above, when the sensor 35 is activated, it sends a signal (in some embodiments via a transceiver as described with respect to FIG. 2 above or in other embodiments directly) to the control panel 28. By the signal from the sensor 35 the control panel 28 is alerted that the door 12 has broken out of the door frame 26. In some embodiments, the control panel 28 will stop the door 12 when the sensor 35 sends a signal to the control panel 28 indicative of a door breakout. Optionally, the control panel 28 will require a user to input a reset command into the control panel 28 before the control panel 28 will further operate the door 12.

In some embodiments, a user may reset the door 12 by raising it to a reset position which is above the door frame 26. The reset position of the door 12 is higher than the door 12 is normally opened when just allowing access through the door 12. Once the door 12 has been risen to the reset position, the door 12 (in some embodiments by gravity) will be realigned to fit in the door frame 26 so that the retainer, 56, the trigger 62 and the sensor 35 will be contained in the frame 26 and the door 12 will extend through the channel 53. Optionally, the user may not need to instruct the control panel 28 to do all the steps to reset the door 12. The control panel 28 may have a preprogramed reset sequence (described above) that will operate the door 12 to be reset to be realigned to the in the door frame 26. In some embodiments, the control panel 28 will at least one of: stop the door, slow down door, and go into a door reset sequence when the controller receives the signal from the sensor.

Optionally, the control panel 30 will detect that the door 12 has risen to the reset position and which will cause the control panel 30 return to a normal operating mode. In other embodiments, a user will manually enter a reset command to cause the control panel 30 to return to a normal operating mode. In still other embodiments, the control panel 30 will automatically raise the door 12 to the reset position and then resume to a normal operating mode.

While the disclosure has been described in terms of exemplary aspects, those skilled in the art will recognize that the disclosure can be practiced with modifications in the spirit and scope of the appended claims. These examples given above are merely illustrative and are not meant to be an exhaustive list of all possible designs, aspects, applications or modifications of the disclosure.

I claim:

1. A door sensor system comprising:

a door;

a sensor located on and configured to move with the door;

a trigger connected to the door and located proximate to the sensor and configured to move to an actuating position, and when in the actuating position, the trigger contacts the sensor causing the sensor to emit a signal, the trigger being biased away from the actuating position; and a camming surface on the trigger, wherein dimensions of the trigger and the trigger's location on the door with respect to the sensor including the location and dimensions of the camming surface cause the trigger to move to the actuating position when the camming surface moves against a door guide forming a channel and the trigger moves out of the channel.

2. The door sensor system of claim 1, wherein the door is located proximate to an opening to selectively provide and deny access to the opening and the door guide is located proximate to the opening, the door guide includes at least one angled surface and the angled surface defines, at least in part, the channel having a width, the channel for guiding and retaining the door in a desired orientation.

3. The door sensor system of claim 2, further including a portion of a retaining structure sized larger than the width of the channel.

4. The door sensor system of claim 3, wherein the door has an outer peripheral edge and the trigger and the sensor are located closer to the outer peripheral edge than the retaining structure is located to the outer peripheral edge.

5. The door sensor system of claim 3, wherein the angled surface of the door guide is configured to flex to allow the channel to widen to allow the retaining structure to move through the channel and out of the door guide.

6. The door sensor system of claim 5, further comprising side structures forming, at least in part, the door guide and the angled surface is connected to the side structures, wherein the angled surface of the door guide and the side structures are configured to flex to allow the channel to widen to allow the retaining structure to move through the channel and out of the door guide.

7. The door sensor system of claim 6, wherein the side structures and the angled surface are made of metal.

8. The door sensor system of claim 7, further comprising an overlapping region where two of the side structures overlap each other.

9. The door sensor system of claim 3, wherein a distance the trigger extends from a surface of the door is smaller than the portion of the retaining structure sized larger than the width of the channel.

10. The door sensor system of claim 2, further comprising a second angled surface located on the door guide opposite the at least one angled surface.

11. The door sensor system of claim 2, wherein the width of the channel is smaller than a distance the trigger extends from a surface of the door so that the trigger moves to the actuating position when the camming surface on trigger moves against the angled surface defining the channel.

12. The door sensor of claim 1, further comprising a door controller operatively connected to the sensor to allow the controller to receive the signal from the sensor.

13. The door sensor of claim 12, wherein the door controller is configured to at least one of:

stop the door, slow down door, and go into a door reset sequence when the controller receives the signal from the sensor.

14. The door sensor of claim 12, wherein the sensor is operatively connected to a transceiver and the sensor sends the signal to the transceiver, and the transceiver sends a signal indicative of the signal the transceiver received from the sensor to the controller.

15. A door sensor system comprising:

a door mounted over an opening, the door configured to move between open and closed positions to allow and deny access through the opening;

a door guide forming a channel located to a side of the opening;

a sensor located on and configured to move with the door;

a trigger connected to the door and located proximate to the sensor and configured to move to an actuating position, and when in the actuating position, the trigger contacts the sensor causing the sensor to emit a signal, the trigger being biased away from the actuating position; and a camming surface on the trigger, wherein dimensions of the trigger and the trigger's location on the door with respect to the sensor including the location and dimensions of the camming surface are selected to cause the trigger to move to the actuating position when the camming surface slides against the door guide channel and when the trigger moves out of the channel.

16. The door sensor system of claim 15, further comprising a door controller operatively connected to the door to actuate the door to the open and closed positions and the sensor is operatively connected to the door controller to input the signal to the door controller.

17. The door sensor system of claim 16, wherein the door controller causes the door to stop when the door controller receives the signal from the sensor.

18. A method for controlling a door having the door sensor system according to claim 1, the method comprising locating the trigger movable to the actuating position on the door;

locating the sensor proximate to the trigger;

providing the door guide; and configuring the location of the trigger and sensor so that when the trigger leaves the door guide, the trigger will contact the door guide and move to the actuating position and contact the sensor causing the sensor to emit the signal.

19. The method of claim 18, further comprising:

configuring a door controller to receive the signal from the sensor;

configuring the door controller to send a door open control signal and a door close control signal; and configuring the door controller to send a stop movement of the door control signal when the controller receives the signal from the sensor.

20. The method of claim 19, further comprising:

operatively connecting the sensor to the door controller; and placing a portion of the door having the trigger and sensor in the door guide.

* * * * *